US008175294B2

(12) United States Patent
Jansen

(10) Patent No.: US 8,175,294 B2
(45) Date of Patent: May 8, 2012

(54) ELECTROSTATIC LOUDSPEAKER WITH SINGLE ENDED DRIVE

(75) Inventor: Arian M. Jansen, Lake Forest, CA (US)

(73) Assignee: Arian M. Jansen, Lake Forest, CA (US)

( * ) Notice: Subject to any disclaimer, the term of this patent is extended or adjusted under 35 U.S.C. 154(b) by 969 days.

(21) Appl. No.: 12/114,671

(22) Filed: May 2, 2008

(65) Prior Publication Data

US 2008/0279398 A1 Nov. 13, 2008

(51) Int. Cl.
*H04R 3/00* (2006.01)

(52) U.S. Cl. ..... 381/116; 381/191

(58) Field of Classification Search ..... 381/116, 381/191

See application file for complete search history.

(56) References Cited

U.S. PATENT DOCUMENTS 4,323,736 A * 4/1982 Strickland ..... 381/116
6,483,924 B1 * 11/2002 Kirjavainen ..... 381/191
7,054,456 B2 * 5/2006 Smits et al. ..... 381/191
7,810,224 B2 * 10/2010 Van Dongen et al. ..... 29/594

* cited by examiner

*Primary Examiner* — Douglas Menz

(57) ABSTRACT

An electrostatic loudspeaker includes a front stator, first and second substantially conductive diaphragms, a center stator and a back stator. The front stator is connected to a safe reference potential such as earth ground. The first diaphragm, the center stator and the back stator are connected to individual positive, non equal DC bias voltages, referenced to the front stator. The second diaphragm is connected to a negative DC bias voltage. A high voltage audio signal, which is referenced to the front stator, is superimposed to the bias voltage of the center stator. The electrostatic loudspeaker can be driven by a single ended audio source. The electrostatic loudspeaker further features an improved electrical safety level.

16 Claims, 7 Drawing Sheets

ELECTROSTATIC LOUDSPEAKER WITH SINGLE ENDED DRIVE

BACKGROUND OF THE INVENTION

1. Field of the Invention

The current invention relates to loudspeakers. More particularly it relates to electrostatic loudspeakers.

2. Description of the Prior Art

The majority of loudspeakers in use nowadays are of the dynamic type. The conventional dynamic loudspeaker utilizes an electromagnetic transducer system, often called the motor, to convert the electrical audio signal into a mechanical force. The electromagnetic transducer is then coupled to a diaphragm, in most cases in the form of a cone, which converts the mechanical force into an air vibration, perceived as sound. In other loudspeaker constructions the motor consists of a piezo electric transducer that drives the diaphragm.

Another type of loudspeaker is the electrostatic loudspeaker, where the current invention relates to. Electrostatic loudspeakers have long been acknowledged for their excellent sound quality and lack of audible distortions and colorations. Due to some practical limitations, the electrostatic loudspeaker has commercially never been widely adopted. Some of the aforementioned practical limitations are: a limited sound pressure, electrical safety, a narrow dispersion of the sound wave and a natural roll off at lower frequency as a result of an acoustical short circuit between the front and back of the loudspeaker. Many possible solutions to these limitations have been presented in the prior art. The current invention specifically addresses the limitations in sound pressure and electrical safety.

Contrary to a conventional dynamic loudspeaker an electrostatic loudspeaker does not include a motor and means to transfer the mechanical energy from the motor to the diaphragm. Instead, the diaphragm of an electrostatic loudspeaker is directly driven by the electric field of the audio signal over its entire surface area. Consequently no colorations and distortions associated with a motor or a mechanical energy transfer means exists in electrostatic loudspeakers. Furthermore, since the diaphragm of a dynamic loudspeaker is driven by the motor on only a single point or a limited area, the diaphragm needs to be mechanically stiff to achieve a substantially consistent excursion of the diaphragm over its entire surface area. The diaphragm of a conventional dynamic loudspeaker is therefore most commonly constructed in the form of a cone or a dome and has a significant thickness to provide the required stiffness. Since the diaphragm of an electrostatic loudspeaker is driven over its entire surface area, mechanical stiffness is not required and the diaphragm can be made as thin as practically feasible. As a consequence of the very thin diaphragm together with the absence of a motor and mechanical energy transfer means, the total moving mass in an electrostatic loudspeaker is orders of magnitudes less than that of a dynamic loudspeaker, which will further reduce distortion.

FIG. 1A illustrates a typical electrostatic loudspeaker construction. The electrostatic loudspeaker (100) comprising of first and second stators (102, 104) a diaphragm (103) and several spacers (101). Said stators consisting of a rigid electrically conductive material with a substantially equal relative open surface area in order to pass sound wave through substantially unimpeded, established by for instance a homogenous perforation pattern over the entire surface area of said stators. The diaphragm (103) consists of a thin flexible film of sufficient electrical conductivity to evenly distribute an electrical charge over its surface. The aforesaid stators (102, 104) and diaphragm (103) can come in a multitude of shapes and forms, including, flat surfaces, curved surfaces and rectangular or substantially circular shapes. The electrostatic loudspeaker panel further includes one or several insulating spacers (101) to provide a substantially constant distance between the stators and the diaphragm over the surface of the panel.

FIG. 1B illustrates a schematic representation of the electrostatic loudspeaker (100) of FIG. 1A including a driving circuit as it is used in the majority of the prior art of electrostatic loudspeakers. When no audio signal is present, both stators (102, 104) are at ground potential. The diaphragm (103) is charged up through resistor (112) by DC voltage source (125). The DC source can have either a positive or negative polarity. Typical potentials for the DC source are between 1000V and 6000V. When the diaphragm is positioned in the middle of the stators, the electrostatic forces between the diaphragm and the front and back stators are equal in force but opposite in direction, consequently cancelling out on the diaphragm. The diaphragm will therefore stay in its centered position. An AC audio signal coming from audio source (135) is applied to the stators (102, 104) by means of a step up transformer (130) with a center tap on its secondary winding which is connected to ground. The AC audio signal from audio source (135) will now appear in opposite phase on the front and back stators of the electrostatic loudspeaker (100) resulting in an AC electric field between the stators proportional to the audio signal from said audio source. The force and excursion of the diaphragm as a result of the AC electric field will produce an audio wave emitting from the diaphragm (103), perpendicular to said diaphragm. Because of the symmetric construction of the electrostatic loudspeaker (100) sound is emitted with substantially equal amplitude from both sides of the diaphragm, but opposite in phase. The electrostatic loudspeakers from FIG. 1 are therefore a dipole loudspeaker.

An alternative driving method for the electrostatic loudspeaker (100) as described above is taught by Smith et al. in U.S. Pat. No. 7,054,456 illustrated in schematic form in FIG. 1C. This invertedly driven electrostatic speaker uses a fixed electrostatic field between the stators (102, 104) generated by DC voltage sources (125) and (126). The high voltage audio source (135) is driving the diaphragm without the need of a balancing transformer. A disadvantage of the electrostatic loudspeaker as described in U.S. Pat. No. 7,054,456 is the need for a diaphragm with a low surface resistance in order to avoid electrical loss of the audio signal in the resistance of said diaphragm. A further disadvantage of said electrostatic loudspeaker is that the front and back stators are connected to high DC voltages, substantially compromising electrical safety.

An electrostatic loudspeaker with enhanced sound pressure is presented by Maeda in U.S. Pat. No. 5,471,540 illustrated in schematic form in FIG. 2. An electrostatic loudspeaker (200) includes three diaphragms and four stators, a first and second DC bias power supply (225,226) of substantially equal but opposite voltage. The front stator (202) and all odd number stators (206) are connected to one side of the balancing transformer (230) and all even number stators (204, 208) are connected to the other side of said balancing transformer. In reference to each individual diaphragm, the stators on each side of the individual diaphragms carry an audio AC voltage proportional to audio source (235), equal in amplitude but opposite in phase. Furthermore diaphragms 203 and 207 have substantially equal but opposite DC bias voltages in comparison to the DC bias voltages on diaphragm 205. As a result of the opposite polarity of the electrical fields caused by the AC voltage from the audio source (235) and the balancing transformer (230) between the different stators and the opposite DC bias voltages on the diaphragms in between the different stators as described above, the electrostatic forces on all diaphragms as a result of the momentary voltage of the audio source (235) and therefore the excursions of all diaphragms occur in the same direction. Consequently the acoustic energy radiating from each diaphragm will be added substantially. Disadvantages of the electrostatic loudspeakers described by U.S. Pat. No. 5,471,540 are an unbalance of the static forces on the diaphragms and a limited ability to reproduce higher frequencies. A further disadvantage of said electrostatic loudspeaker is that the front and back stators are connected to high AC voltages, substantially compromising electrical safety.

SUMMARY OF THE DISCLOSURE

An electrostatic loudspeaker includes a front stator, a substantially conductive diaphragm and a back stator. The electrostatic loudspeaker further includes a first and second capacitor, a resistor and a bias power supply. The front stator is connected to a reference potential such as, but not limited to earth or ground potential. The first capacitor is connected between the front stator and the diaphragm and the second capacitor is connected between the back stator and the diaphragm. The bias power supply provides a DC bias voltage referenced to the front stator through the resistor to the diaphragm. The audio driver signal is supplied to the back stator. The audio driver signal is supplied from a single ended source referenced to the reference potential.

In a second embodiment of the invention an electrostatic speaker includes N diaphragms and N+1 stators, four capacitors and a first and second bias power supply of substantially equal but opposite voltage. The front stator and all odd number stators are connected to the reference potential and all even number stators are connected to the single ended audio source. All even numbered diaphragms are connected through a resistor to the first bias power supply and all odd numbered diaphragms are connected through a resistor to the second bias power supply.

It is an object of the invention to drive an electrostatic speaker from a single ended audio signal source. It is a further object of the invention to provide a front stator that is substantially free of DC and/or AC voltage potentials with respect to the environment in order to substantially increase the electrical safety of electrostatic loudspeakers. It is yet another object of the invention to increase the acoustic sensitivity of the electrostatic loudspeaker by adding multiple diaphragms and stators. It is yet a further object of the invention to provide a back stator that is substantially free of DC and/or AC voltage potentials with respect to the environment in order to substantially increase the electrical safety of electrostatic loudspeakers.

DETAILED DESCRIPTION OF THE INVENTION

Figure 1B:
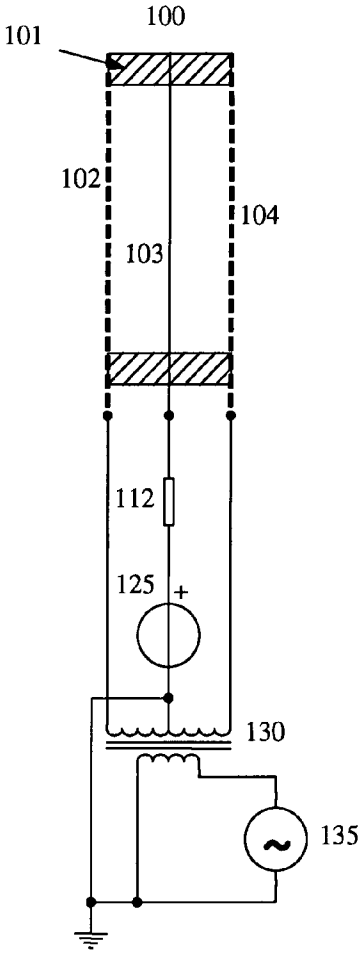
Fig. 1B (Prior Art)
FIG. 1B (Prior Art) illustrates a schematic representation of the electrostatic loudspeaker panel of FIG. 1A and the typical driving method used in the prior art.
Figure 1A:
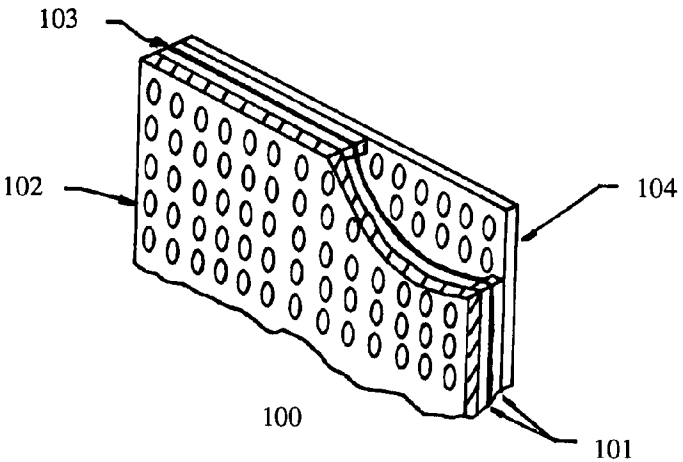
Fig. 1A (Prior Art)
FIG. 1A (Prior Art) shows a typical construction of an electrostatic loudspeaker panel.
Figure 1C:
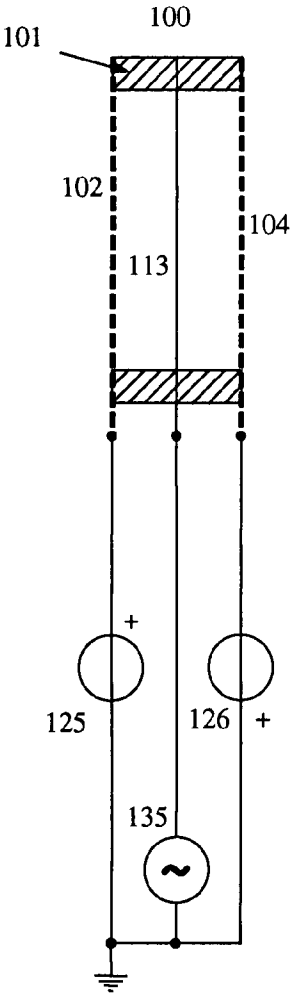
Fig. 1C (Prior Art)
FIG. 1C (Prior Art) illustrates the driving method used by Smith et al. in U.S. Pat. No. 7,054,456.
Figure 3:
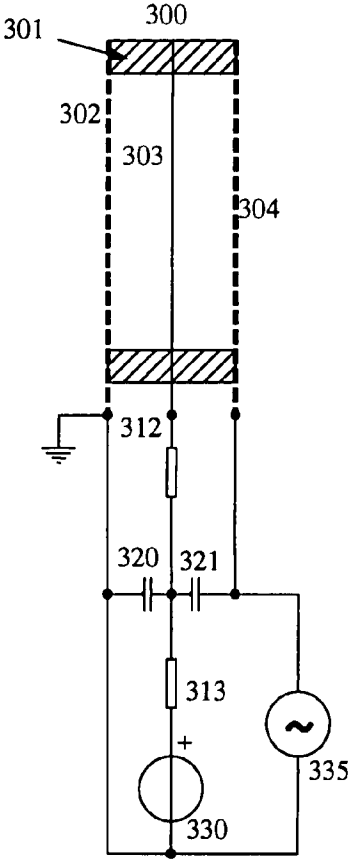
FIG. 3 shows a first embodiment of the current invention implemented with a conventional electrostatic loudspeaker panel.

FIG. 3 illustrates a conceptual representation of a first embodiment of the invention. An electrostatic loudspeaker panel (300) includes a front stator (302), a substantially electrically conductive diaphragm (303) and a back stator (304). Said front and back stators consist of a rigid electrically conductive material with a substantially equal relative open surface area in order to pass sound wave through substantially unimpeded, established by, but not limited to for instance a homogenous perforation pattern over the entire surface area of said stators. The diaphragm consists of a thin flexible film of sufficient electrical conductivity to evenly distribute an electrical charge over its surface. The aforesaid stators and diaphragms can come in a multitude of shapes and forms, including, but not limited to flat surfaces, curved surfaces and rectangular or substantially circular shapes. The electrostatic loudspeaker panel further includes one or several insulating spacers (301) to provide a substantially controlled distance, such as, but not limited to a constant distance between the stators and the diaphragm over the surface of the panel. The front stator is connected to a safe reference potential such as, but not limited to earth or ground potential. A DC bias voltage source (330), referenced to the same reference potential as the front stator (302), is connected to the diaphragm through a first resistor (313) and a second resistor (312). A single ended high voltage audio source (335), referenced to the same reference potential as the front stator, is connected to the back stator (304). First and second capacitors (320, 321), connected in series, are connected across the audio source (335) in order to substantially divide the amplitude of the audio signal by a factor of two. The junction of the first and second capacitors (320, 321) is connected to the junction of the first and second bias resistors (313, 312). The time constant of the first bias resistor (313) and the sum of the first and second capacitors is substantially longer than the period of the lowest audio frequency intended to be reproduced by the electrostatic loudspeaker panel (300). The AC voltage amplitude from the audio source (335) on the back stator will be twice as high as the amplitude of the audio AC voltage on the diaphragm. In reference to the voltage on the diaphragm, the audio AC voltage on the front stator is equal in amplitude, but opposite in phase to the audio AC voltage on the back stator. The electrostatic forces exercised on the diaphragm (303) as a result of the AC voltage of the audio source (335) is similar to the forces exercised to the diaphragm (103) of the electrostatic loudspeaker in the prior art of FIG. 1. The transducer characteristics of the electrostatic loudspeaker of FIG. 3 incorporating the current invention are therefore substantially equal to the transducer characteristics of the electrostatic loudspeaker (100) in the prior art of FIG. 1. It is a benefit of the current invention that the electrostatic loudspeaker in FIG. 3 can be driven with a single ended audio source (335), without the need for a balancing transformer (130) as shown in FIG. 1. It is a further benefit of the current invention that the front stator (302) can be connected to an electrically safe potential such as, but not limited to earth ground.

Figure 2:
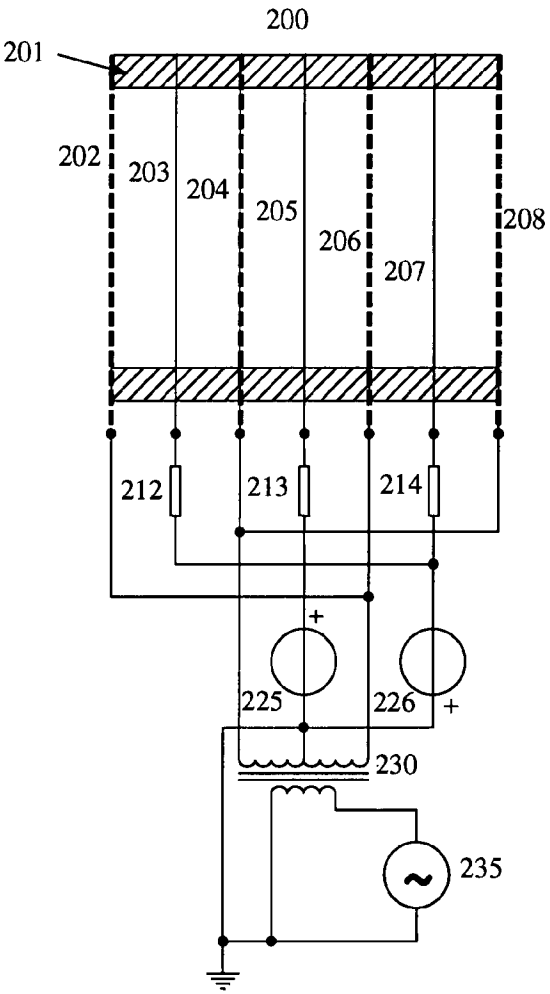
Fig. 2 (Prior Art)
FIG. 2 (Prior Art) illustrates electrostatic loudspeaker panel construction and driving method as described by Maeda in U.S. Pat. No. 5,471,540
Figure 5:
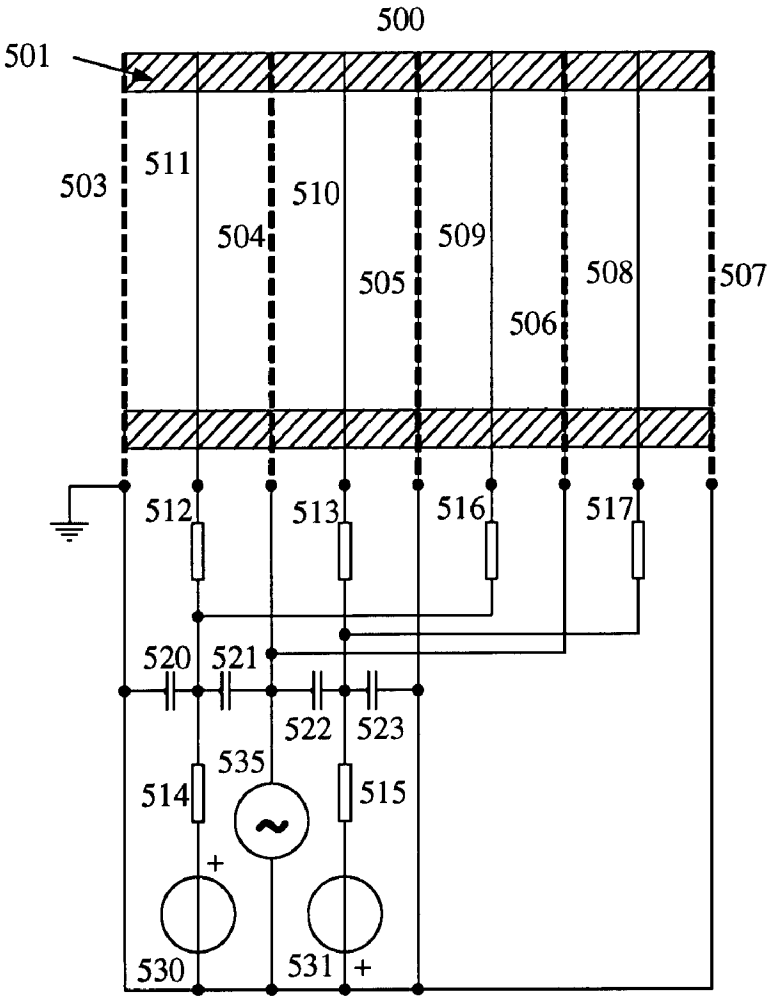
FIG. 5 shows the second embodiment of the current invention in an electrostatic loudspeaker panel with N diaphragms and N+1 stators where N=4.

In a second embodiment of the current invention an electrostatic speaker panel includes N diaphragms and N+1 stators, four capacitors and a first and second DC bias power supply of substantially equal but opposite voltage. The front stator and all odd number stators are connected to the reference potential and all even number stators are connected to the single ended audio source. An example of the second embodiment is shown in FIG. 5 where N equals 4. In this embodiment of the invention an electrostatic speaker panel (500) includes four diaphragms (511,510,509,508) and five stators (503,504,505,506,507), four capacitors (520,521,522, 523) and a first and second DC bias power supply (530,531) of substantially equal but opposite voltage. The front stator (503) and all odd number stators (505,507) are connected to the reference potential and all even number stators (504,506) are connected to the single ended audio source (535). All odd numbered diaphragms (511,509) are connected through a first, second and third resistor (514,512,516) to the first DC bias power supply (530) and all even numbered diaphragms (510, 508) are connected through a fourth, fifth and sixth resistor (515,513,517) to the second DC bias power supply (531). First and second capacitors (520, 521), connected in series, are connected across the audio source (535) in order to substantially divide the amplitude of the audio signal by a factor of two. The junction of the first and second capacitors (520, 521) superimposes the divided audio signal from audio source (535) to the bias voltage on the odd numbered diaphragms (511,509). Similarly, the third and fourth capacitors (522, 523), connected in series, are connected across the audio source (535) in order to substantially divide the amplitude of the audio signal by a factor of two. The junction of the third and fourth capacitors (522, 523) superimposes the divided audio signal from audio source (535) to the bias voltage on the even numbered diaphragms (510,508). In reference to each individual diaphragm, the stators on each side of the individual diaphragms carry a portion of the audio AC voltage from the audio source (535), equal in amplitude but opposite in phase. The electrostatic forces exercised on the diaphragms of electrostatic loudspeaker (500) incorporating the current invention as a result of the AC voltage of the audio source (535) is similar to the forces exercised to the diaphragms of the electrostatic loudspeaker (200) in the prior art of FIG. 2. The polarity and amplitude of the electrical field caused by the AC voltage from the audio source (535) between stators 503 and 504 and between stators 505 and 506 are substantially the same. The polarity and amplitude of the electrical field caused by the AC voltage from the audio source (535) between stators 504 and 505 and between stators 506 and 507 are substantially the same, but opposite in polarity to the electrical fields between stators 503 and 504 and between stators 505 and 506. Furthermore diaphragms 511 and 509 have substantially equal but opposite DC bias voltages in comparison to the DC bias voltages on diaphragms 510 and 508. As a result of the opposite polarity of the electrical fields caused by the AC voltage from the audio source (535) between the different stators and the opposite DC bias voltages on the diaphragms in between the different stators as described above, the electrostatic forces on all diaphragms as a result of the momentary voltage of the audio source (535) and therefore the excursions of all diaphragms are substantially the same and occur in the same direction. Consequently the acoustic energy radiating from each diaphragm will be added substantially. It is a benefit of this embodiment of the current invention that the sensitivity of the electrostatic loudspeaker with N diaphragms and N+1 stators, where N is larger or equal to two, is substantially higher. It is a further benefit of this embodiment of the current invention that the electrostatic loudspeaker with N diaphragms and N+1 stators can be driven from a single ended audio source. It is yet another benefit of this embodiment of the current invention that the electrostatic loudspeaker with N diaphragms and N+1 stators, where N is an even number larger than zero, includes a front stator and a back stator that can both be connected to an electrically safe reference potential such as, but not limited to earth ground. It is yet another benefit of this embodiment of the current invention that the electrostatic loudspeaker with N diaphragms and N+1 stators, where N is an even number larger than zero, includes a front stator and a back stator that can both be connected to the same reference potential such as, but not limited to earth ground, where said front stator and back stator provide effective shielding for the electrical stray fields caused by the stators driven by the single ended audio source. The external electrical stray fields of the electrostatic loudspeaker incorporating the current inventions is magnitudes lower than the stray fields of the electrostatic loudspeakers in the prior art as shown in FIGS. 1 and 2.

Figure 4B:
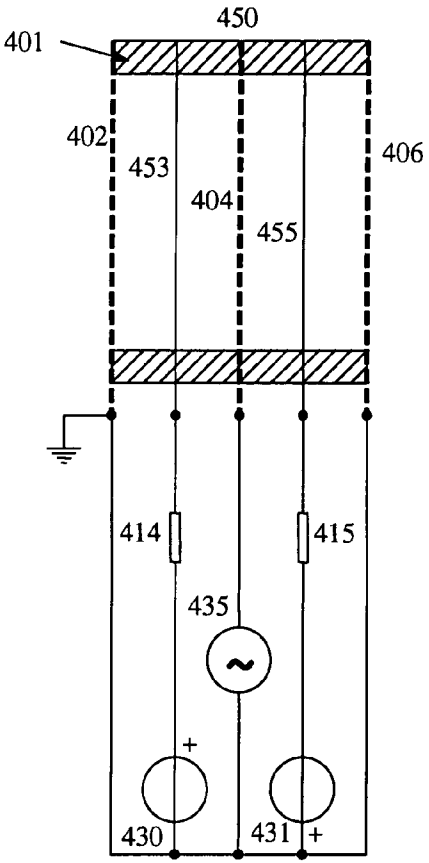
FIG. 4B illustrates a further simplification of FIG. 4A.
Figure 4A:
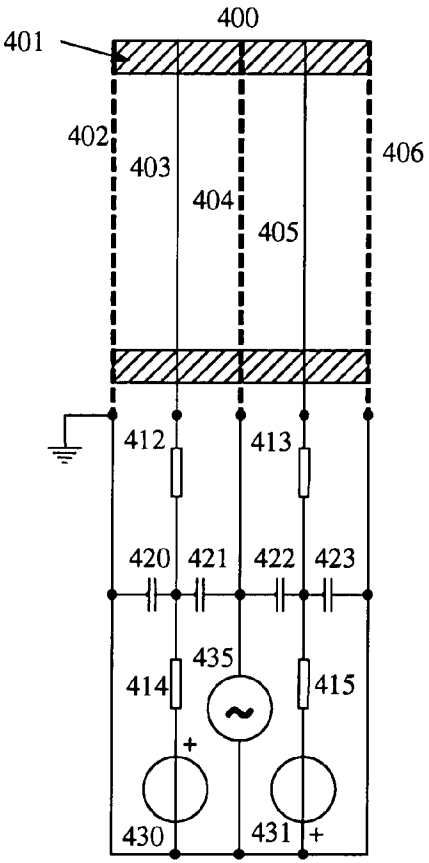
FIG. 4A shows a second embodiment of the current invention in an electrostatic loudspeaker panel with N diaphragms and N+1 stators where N=2.

FIG. 4A shows the preferred embodiment of the first aspect of the current invention. In the preferred embodiment of the first aspect of the current invention an electrostatic speaker panel (400) includes two diaphragms (403,405) and three stators (402,404,406), four capacitors (420,421,422,423) and a first and second DC bias power supply (430,431) of substantially equal but opposite voltage. The front stator (402) and the back stator (406) are connected to an electrically safe reference potential such as, but not limited to earth ground. A single ended high voltage audio source (435), referenced to the same reference potential as the front stator, is connected to the center stator (404). The first diaphragm (403) is connected through a first and second resistor (414,412) to the first DC bias power supply (430) and the second diaphragm (405) is connected through a third and fourth resistor (415,413) to the second DC bias power supply (431). First and second capacitors (420, 421), connected in series, are connected across the audio source (435) in order to substantially divide the amplitude of the audio signal by a factor of two. The junction of the first and second capacitors (420, 421) superimposes the divided audio signal from audio source (435) to the bias voltage on the first diaphragm (403). Similarly, the third and fourth capacitors (422, 423), connected in series, are connected across the audio source (435) in order to substantially divide the amplitude of the audio signal by a factor of two. The junction of the third and fourth capacitors (422, 423) superimposes the divided audio signal from audio source (435) to the bias voltage on the second diaphragm (405). In reference to each individual diaphragm, the stators on each side of the individual diaphragms carry a portion of the audio AC voltage from the audio source (435), equal in amplitude but opposite in phase. The electrostatic forces as a result of the AC voltage of the audio source (435) exercised on the diaphragms of electrostatic loudspeaker (400) incorporating the current invention is similar to the forces exercised to the diaphragms of the electrostatic loudspeakers (100,200) in the prior art of FIG. 1 and FIG. 2. The amplitude of the electrical field caused by the AC voltage from the audio source (435) between stators 402 and 404 is substantially the same, but opposite in polarity to the electrical field between stators 404 and 406. Furthermore diaphragm 403 has substantially equal but opposite DC bias voltage in comparison to the DC bias voltage on diaphragm 405. As a result of the opposite polarity of the electrical fields caused by the AC voltage from the audio source (435) between the different stators and the opposite DC bias voltages on the diaphragms (403,405) in between the different stators as described above, the electrostatic forces on said diaphragms as a result of the momentary voltage of the audio source (435) and therefore the excursions of said diaphragms are substantially the same and occur in the same direction. Consequently the acoustic energy radiating from each diaphragm will be substantially added. It is a benefit of the preferred embodiment (FIG. 4A) of the first aspect of the current invention that the sensitivity of the electrostatic loudspeaker with two diaphragms and three stators, is substantially doubled for a given audio signal coming from the audio source. It is a further benefit of the preferred embodiment of the first aspect of the current invention that the electrostatic loudspeaker with two diaphragms and three stators can be driven from a single ended audio source. It is yet another benefit of the preferred embodiment of the first aspect of the current invention that the electrostatic loudspeaker with two diaphragms and three stators, includes a front stator and a back stator that can both be connected to an electrically safe reference potential such as, but not limited to earth ground. It is yet another benefit of the preferred embodiment of the first aspect of the current invention that the electrostatic loudspeaker with two diaphragms and three stators, includes a front stator and a back stator that can both be connected to the same reference potential such as, but not limited to earth ground, where said front stator and back stator provide effective shielding for the electrical stray fields caused by the stators driven by the single ended audio source. The external electrical stray fields of the electrostatic loudspeaker incorporating the current inventions is magnitudes lower than the stray fields of the electrostatic loudspeakers in the prior art as shown in FIGS. 1 and 2.

A further simplification of the current invention can be achieved if the conductivity of the diaphragm is relatively high. Said simplification of the current invention is shown in FIG. 4B. An electrostatic loudspeaker (450) includes two diaphragms (453,455) and three stators (402,404,406), and a first and second DC bias power supply (430,431) of substantially equal but opposite voltage. The front stator (402) and the back stator (406) are connected to an electrically safe reference potential such as, but not limited to earth ground. A single ended high voltage audio source (435), referenced to the same reference potential as the front stator, is connected to the center stator (404). The first diaphragm (453) is connected through a first resistor (414) to the first DC bias power supply (430) and the second diaphragm (455) is connected through a second resistor (415) to the second DC bias power supply (431). A first requirement to achieve a substantially homogeneous acoustic radiation pattern from an electrostatic loudspeaker is a substantially homogeneous electrical charge across the surface of the diaphragm. Other parameters also have influence on the radiation pattern of an electrostatic loudspeaker, however said parameters are outside the scope of this teaching. In the embodiments of the current invention shown in FIGS. 3, 4A and 5 the electrical charge on the diaphragms remain substantially homogeneous regardless of the surface conductivity of the diaphragms. In for example the electrostatic loudspeaker of FIG. 3, incorporating the current invention, the electrical charge is submitted to the diaphragm (303) from DC source (330), through a first and second resistors (313, 312). The first and second capacitors (320, 321) are charged to substantially the same electrical potential as the diaphragm (303). The AC audio signal from audio source (335) is submitted to the back stator (304) while the front stator (302) is connected to the reference potential. The amplitude of AC audio signal will be substantially divided by a factor of two at the junction of the first and second capacitor (320,321). The amplitude of the AC audio signal will also be substantially divided by a factor of two at the connection of the diaphragm as a result of the inherent and substantially equal capacitances between the front stator (302) and the diaphragm (303) and between said diaphragm and the back stator (304). Consequently, the voltage across the second resistor (312) and therefore also the current through said resistor as a result of the AC audio signal from the audio source (335) is substantially zero. Since no electrical charge can be moved to and from the diaphragm (303) as a result of the AC audio signal, also no significant charge movements will take place over the surface of said diaphragm. In FIG. 4B, the four voltage divider capacitors (420,421,422,423) and two resistors (412,413) have been removed. If the conductivity of the diaphragms (453,455) is high enough such that the resistance between any two points on the surface of said diaphragms is significantly much lower than de resistance of resistors 414 and 415, and the time constant of resistors 414 and 415 and the capacitances of diaphragms 453 and 455 with respect to stators 402, 404 and 406 is significantly longer than the period of the lowest frequency intended to be reproduced by the electrostatic loudspeaker incorporating the current invention, the movement of electrical charge across the surface of said diaphragms will be minimal. It is a benefit of the simplification to this embodiment of the current invention that the number of external components is reduced. It is a further benefit of the simplification to this embodiment of the current invention that the capacitance across the audio source (435) is reduced as a result of the omission of capacitors 420, 421, 422 and 423. The simplification as described above can also be applied to other embodiments of the current invention such as, but not limited to, the electrostatic loudspeakers shown in FIG. 3 and FIG. 5.

A frequency dependent reproduction limitation exists in the electrostatic loudspeaker with N diaphragms and N+1 stators, where N is larger or equal to two, such as the electrostatic loudspeakers shown in FIGS. 4A, 4B and 5. Also the electrostatic loudspeaker with multiple plate electrodes as described by Maeda in U.S. Pat. No. 5,471,540 is subject to said frequency dependent reproduction limitation, however this limitation is not mentioned in Maeda's patent. As described earlier in this teaching, in the electrostatic loudspeaker with N diaphragms and N+1 stators, where N is larger or equal to two, the excursions of all diaphragms are substantially the same and occur in the same direction. Consequently the acoustic energy radiating from each diaphragm will be added substantially. The addition of the energies from the individual diaphragms is only occurring when one half of the wavelength of the frequency being reproduced by the aforesaid electrostatic loudspeakers is magnitudes longer than the physical distance between any of said diaphragms. When one half of the wavelength of the frequency being reproduced by said electrostatic loudspeakers approaches the distance between any two diaphragms, the acoustic output of said diaphragms will no longer be added in full and the acoustic level radiating from the electrostatic loudspeaker will diminish. When one half of the wavelength of the frequency being reproduced by the aforesaid electrostatic loudspeakers is substantially equal to the distance between any two diaphragms of the electrostatic loudspeaker with N diaphragms and N+1 stators, where N is larger or equal to two, the acoustic output of said diaphragms are substantially canceled, and a trough will occur in the frequency characteristic of said electrostatic loudspeaker. In the embodiment of the current invention in the electrostatic loudspeaker with two diaphragms and three stators as shown in FIGS. 4A and 4B, the acoustic output of said electrostatic loudspeakers (400,450) will be substantially zero when one half of the wavelength of the frequency being reproduced by said electrostatic loudspeakers is substantially equal to the distance between said two diaphragms (403,405 and 453,455).

Two methods will be described to overcome the aforesaid frequency dependent reproduction limitation of the electrostatic loudspeakers of the prior art, including, but not limited to the electrostatic loudspeaker with multiple plate electrodes as described by Maeda in U.S. Pat. No. 5,471,540, and the electrostatic loudspeaker with N diaphragms and N+1 stators, as described in the current teaching.

Figure 6:
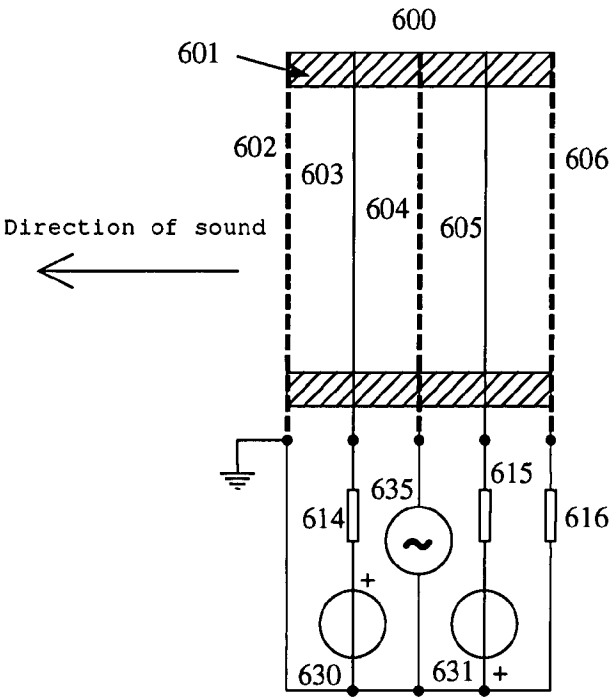
FIG. 6 shows a first method to overcome the frequency dependent reproduction limitation of an electrostatic loudspeaker panel with N diaphragms and N+1 stators.

A first method to overcome said frequency dependent reproduction limitation is described in reference to FIG. 6. Said first method is described using the electrostatic loudspeaker with N diaphragms and N+1 stators, where N is equal to two as shown in FIG. 6. However, the first method to overcome said frequency dependent reproduction limitation described hereafter is valid for all electrostatic loudspeakers with N diaphragms and N+1 stators, where N is equal or larger than two. The construction details to implement the first solution to overcome said frequency dependent reproduction limitation of electrostatic loudspeakers with N diaphragms and N+1 stators, where N is larger than two, or any of the electrostatic loudspeakers of the prior art including, but not limited to the electrostatic loudspeakers with multiple plate electrodes as described by Maeda in U.S. Pat. No. 5,471,540, can be easily obtained from the teaching below by any person with ordinary skills in the art.

The electrostatic loudspeaker (600) as shown in FIG. 6 includes two diaphragms (603,605) and three stators (602, 604,606), and a first and second DC bias power supply (630, 631) of substantially equal but opposite voltage. The front stator (602) is connected to an electrically safe reference potential such as, but not limited to earth ground. A single ended high voltage audio source (635), referenced to the same reference potential as the front stator, is connected to the center stator (604). The back stator (606) is connected through a first resistor (616) to the same reference potential as the front stator. The first diaphragm (603) is connected through a second resistor (614) to the first DC bias power supply (630) and the second diaphragm (605) is connected through a third resistor (615) to the second DC bias power supply (631). The intrinsic capacitance between the center stator (604) and the back stator (606), connected in series with the first resistor (616), are connected across the audio source (635). At corner frequency (Fc), the apparent impedance of the intrinsic capacitance between the center stator (604) and the back stator (606) and the first resistor is substantially equal. At said corner frequency (Fc) the AC voltages, derived from the audio source (635), across the capacitance between the center stator (604) and the back stator (606) and across the first resistor are substantially equal. For frequencies lower than said corner frequency the AC voltage across the capacitance between the center stator (604) and the back stator (606) is larger than the voltage across the first resistor (616). For frequencies higher than said corner frequency the AC voltage across the intrinsic capacitance between the center stator (604) and the back stator (606) is smaller than the voltage across the first resistor (616). Consequently, for frequencies significantly higher than said corner frequency the AC voltage between the center stator (604) and the back stator (606) is significantly lower than the AC voltage between the front stator (602) and the center stator (604), which is always substantially equal to the AC voltage from the audio source (635). As a result, for frequencies significantly higher than said corner frequency, the contribution of the second diaphragm (605) to the total acoustic output pressure of the electrostatic loudspeaker (600) is significantly smaller than the contribution of the first diaphragm (603). For frequencies significantly lower than said corner frequency, the contribution of the second diaphragm (605) to the total sound output pressure of the electrostatic loudspeaker (600) is substantially equal to the contribution of the first diaphragm (603). By adjusting the value of the first resistor (616), the corner frequency (Fc) can be chosen to appear below the frequency of which one half of the wavelength is substantially equal to the distance between the first and second diaphragms (603,605). The substantial cancellation of the acoustic output of said first and second diaphragms, causing a trough in the frequency characteristic of the electrostatic loudspeakers of FIGS. 4A and 4B, is effectively avoided in the electrostatic loudspeaker of FIG. 6.

A first preferred determination of the corner frequency (Fc) is at the frequency of which one quarter of the wavelength is substantially equal to the distance between the first and second diaphragms (603,605). The acoustic output of the electrostatic loudspeaker (600) for frequencies higher than the corner frequency will be lower than the acoustic output for frequencies lower than the corner frequency. Adequate compensation in the driver circuit may be required.

A second preferred determination of the corner frequency (Fc) is at the frequency where the natural low frequency roll off of the electrostatic loudspeaker commences. Electrostatic loudspeakers show a natural roll off at the low end of the frequency characteristic as a result of the physical size of the electrostatic panels. By placing the corner frequency (Fc) at the natural roll off frequency of the electrostatic panels, the low frequency response can be extended.

The first diaphragm (604) of the electrostatic loudspeaker (600) shown in FIG. 6 with determined corner frequency (Fc) for the back stator (606) reproduces the full frequency range as produced by the audio source (635), while the second diaphragm (605) mainly reproduces frequencies lower than the corner frequency (Fc). The preferred direction of the sound is therefore perpendicular to the first diaphragm (603), through the front stator (602). However the electrostatic loudspeaker (600) shown in FIG. 6 also produces sound in the opposite direction and can therefore also be used for reproducing sound in the direction perpendicular to the second diaphragm (605), through the back stator (606).

It is a benefit of the electrostatic loudspeaker (600) shown in FIG. 6 with determined corner frequency (Fc) for the back stator (606) that cancellation of the acoustic energy of the first and second diaphragms (603, 605) is avoided. It is a further benefit of the electrostatic loudspeaker (600) shown in FIG. 6 with determined corner frequency (Fc) for the back stator (606), that the natural low frequency roll off of the electrostatic loudspeaker can be partially compensated.

A second method to overcome the aforesaid frequency dependent reproduction limitation of the electrostatic loudspeakers of the prior art as described by Maeda in U.S. Pat.

Figure 7:
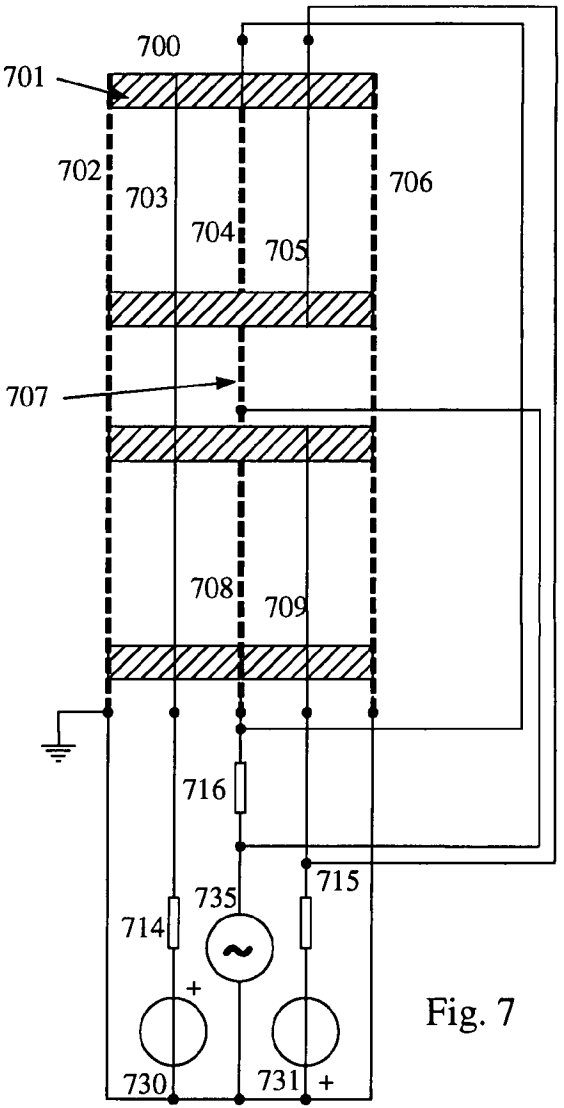
FIG. 7 shows a second method to overcome the frequency dependent reproduction limitation of an electrostatic loudspeaker panel with N diaphragms and N+1 stators.

No. 5,471,540, and the electrostatic loudspeaker with N diaphragms and N+1 stators, where N is equal or larger than two, as described in the current teaching, is described in reference to FIG. 7. An electrostatic speaker (700) includes three diaphragms (703,705,709), a front stator (702), a back stator (706) and a center stator which is divided in two or more electrically insulated segments. In the example of FIG. 7 the number of electrically insulated segments is three (704,707, 708). Said electrostatic loudspeaker further includes a first and second DC bias power supply (730,731) of substantially equal but opposite voltage. The front stator (702) and the back stator (706) are connected to a electrically safe reference potential such as, but not limited to earth ground. A single ended high voltage audio source (735), referenced to the same reference potential as the front stator, is directly connected to one (707) or more of the electrically insulated segments of the center stator. The single ended high voltage audio source (735) is also connected through a first resistor to one or more other electrically insulated segments of the center stator (704, 708). The first diaphragm (703) is connected through a second resistor (714) to the first DC bias power supply (730) and the second and third diaphragms (705,709) are connected together and further connected through a third resistor (715) to the second DC bias power supply (731). The segments of the center stator (707) that are directly connected to said AC audio source (735) only have a first diaphragm (703) between said segments of the center stator and the front stator (702), but have no diaphragm between said segments of the center stator and the back stator (706). Consequently, the sections of the electrostatic loudspeaker that are driven by said segments of the center stator (707) will reproduce all frequencies generated by the AC audio source (735) without the troughs in the frequency characteristic caused by the acoustic energy cancellation of a second diaphragm. The segments of the center stator (704,708) that are connected to said AC audio source (735) through a resistor (716) have a first diaphragm (703) between said segments of the center stator and the front stator (702), and second diaphragms (705,709) between said segments of the center stator and the back stator (706). Consequently the sections of the electrostatic loudspeaker that are driven by said indirectly connected segments of the center stator (704,708) exhibit troughs in the frequency characteristic when one half of the wavelength of the frequency being reproduced by the said sections of the electrostatic loudspeakers is substantially equal to the distance between the two diaphragms of said sections of the electrostatic loudspeaker. The intrinsic capacitances between the center stator segments (704,708) and the front and back stator (702,706), together with the first resistor (716) form a first order low pass filter with corner frequency (Fcl). As a result, for frequencies significantly higher than said corner frequency, the contribution of the sections of the electrostatic loudspeaker with first and second diaphragms to the total acoustic output pressure of the electrostatic loudspeaker (700) is significantly smaller than the contribution of the section with only first diaphragms. By adjusting the value of the first resistor (716), the corner frequency (Fcl) can be chosen to appear below the frequency of which one half of the wavelength is substantially equal to the distance between the first and second diaphragms (703,705, 709). The substantial cancellation of the acoustic output of said first and second diaphragms, causing a trough in the frequency characteristic of the electrostatic loudspeakers of FIGS. 4A and 4B, is effectively avoided in the electrostatic loudspeaker of FIG. 7.

A first preferred determination of the corner frequency (Fcl) is at the frequency of which one quarter of the wavelength is substantially equal to the distance between the first and second diaphragms (703,705,709). The acoustic output of the electrostatic loudspeaker (700) for frequencies higher than the corner frequency will be lower than the acoustic output for frequencies lower than the corner frequency. Adequate compensation in the driver circuit may be required.

A second preferred determination of the corner frequency (Fcl) is at the frequency where the natural low frequency roll off of the electrostatic loudspeaker commences. By placing the corner frequency (Fc) at the natural roll off frequency of the electrostatic panels, the low frequency response can be extended.

It is a benefit of the electrostatic loudspeaker (700) shown in FIG. 7 with determined corner frequency (Fcl) for the sections of the said electrostatic loudspeaker with multiple diaphragms that troughs in the frequency characteristic of the entire loudspeaker (700) as a result of cancellation of the acoustic energy of the first and second diaphragms (703, 705,709) are substantially reduced. It is a further benefit of the electrostatic loudspeaker (700) shown in FIG. 7 with determined corner frequency (Fcl) for the sections of the said electrostatic loudspeaker with multiple diaphragms, that the natural low frequency roll off of the electrostatic loudspeaker can be partially compensated. It is yet another benefit of the electrostatic loudspeaker (700) shown in FIG. 7 with determined corner frequency (Fcl) for the sections of the said electrostatic loudspeaker with multiple diaphragms, that said loudspeaker includes a front stator and a back stator that can both be connected to an electrically safe reference potential such as, but not limited to earth ground. It is yet another benefit of the electrostatic loudspeaker (700) shown in FIG. 7 with determined corner frequency (Fcl) for the sections of the said electrostatic loudspeaker with multiple diaphragms, that said loudspeaker includes a front stator and a back stator that can both be connected to the same reference potential such as, but not limited to earth ground, where said front stator and back stator provide effective shielding for the electrical stray fields caused by the stators driven by the single ended audio source.

In the prior art, such as the electrostatic loudspeaker with multiple plate electrodes as described by Maeda in U.S. Pat. No. 5,471,540, but also in the electrostatic loudspeakers with N diaphragms and N+1 stators, where N is equal or larger than two, as described in the current teaching, an unbalance in the electrostatic forces exerted to the diaphragms when no audio signal is applied can cause the diaphragms to be physically offset to one side. This offset may cause irregularities in the reproduction capabilities of the aforementioned electrostatic loudspeakers, such as, but not limited to distortion and instability.

In the electrostatic loudspeaker of the prior art as described in FIG. 1, and also in the electrostatic loudspeaker incorporating the first embodiment of the current invention as described in FIG. 3, the diaphragms (103,303) are placed in the center of two substantially conductive stators (102,104, 302,304) of equal size and shape. When no audio signal is applied, both stators are connected to the same potential and the diaphragm is connected to a positive or negative bias voltage as supplied by the DC power source (130,330). Since the distance between the first stator (102,302) and the diaphragm (103,303) is the same as the distance between the second stator (104,304) and the diaphragm (103,303), the electrostatic forces on said diaphragm are canceled and said diaphragm remains physically centered in between said first and second stators. The stators in electrostatic loudspeakers exhibit a significant level of open area for the sound emitted from the diaphragm to pass through. Typical values for open area in relation to total surface area of the stators are between 25% and 60%. As a result of the relative open area of the stators, the electrostatic forces for any given voltage and distance between stators and diaphragm are reduced. If the first and second stators have similar open area ratios, the electrostatic forces will be equally reduced in comparison to fully closed stators and the forces on the diaphragms will still be canceled so that the diaphragm will remain centered in between said first and second stators. It is determined in this teaching that the reduction of electrostatic forces between a stator and a diaphragm as a result of the open area of the stator is substantially linear in relation to the reduction of capacitance between the stator and the diaphragm in comparison to the capacitance between a fully closed stator and the diaphragm.

In the prior art, such as the electrostatic loudspeaker with multiple plate electrodes as described by Maeda in U.S. Pat. No. 5,471,540, and also in the electrostatic loudspeakers with N diaphragms and N+1 stators, where N is equal or larger than two, as described in the current teaching, all stators have a substantially open area. FIG. 6 will serve as an example for the current teaching of the unbalance in the electrostatic loudspeakers with N diaphragms and N+1 stators. The electrostatic loudspeaker (600) as shown in FIG. 6 includes two diaphragms (603,605) and three stators (602,604,606), and a first and second DC bias power supply (630,631) of substantially equal but opposite voltage. The front stator (602) is connected to an electrically safe reference potential such as, but not limited to earth ground. A single ended high voltage audio source (635), referenced to the same reference potential as the front stator, is connected to the center stator (604). The back stator (606) is connected through a first resistor (616) to the same reference potential as the front stator. The first diaphragm (603) is connected through a second resistor (614) to the first DC bias power supply (630) and the second diaphragm (605) is connected through a third resistor (615) to the second DC bias power supply (631). When the output of the AC audio source (635) is zero, the electrical potential on said first, second and third stators is substantially equal to the reference voltage. The electrical potential of the first diaphragm (603) is substantially equal to the DC voltage of the first DC bias power supply (630), and the electrical potential of the second diaphragm (605) is substantially equal to the DC voltage of the second DC bias power supply (631). The voltages on said first and second diaphragms will be substantially equal in absolute value, but opposite in polarity with respect to the reference voltage on the first, second and third stators (602,604,606). If said first, second and third stators are fully closed plates with effectively 0% of open area, the electrostatic forces on the first diaphragm (603) as a result of the relative electrical charge of said first diaphragm in reference to the first and second stators (602,604) are substantially canceled, since the distance between said first stator and said first diaphragm is the same as the distance between said second stator and said first diaphragm. Consequently said first diaphragm physically remains substantially centered in between said first and second stators. Similarly as described for said first diaphragm, the second diaphragm (605) physically remains substantially centered in between the second and third stators (604,606). If said first, second and third stators have a substantially equal relative open surface area established by, but not limited to for instance a homogenous perforation pattern over the entire surface area of said stators, the electrostatic forces exerted on the first and second diaphragms as a result of the relative electrical charge of said first and second diaphragms in reference to said first, second and third stators are reduced equally. However an additional electrostatic force exists between the first and second diaphragms (603,605). Said first and second diaphragms are connected to substantially equal DC power supplies of opposite polarity. Consequently, said first and second diaphragms will exert an attracting force to each other through the open area of the center stator (604). As a result, the sum of all electrostatic forces exerted on the first diaphragm (603) and the second diaphragm (605) directed towards the center stator (604) are larger than the sum of all electrostatic forces exerted on said first diaphragm in the direction of the first stator (602) and the sum of all electrostatic forces exerted on said second diaphragm in the direction of the third stator (606). This unbalance of electrostatic forces on either sides of said first and second diaphragms result in a continuous tendency for said first and second diaphragms to pull towards the center stator (604) instead of for said first diaphragm to remain substantially centered in between the first and second stators (602, 604) and for said second diaphragm to remain substantially centered in between the second and third stators (604,606). This unbalance may cause irregularities in the reproduction capabilities of the aforementioned electrostatic loudspeakers, including, but not limited to distortion and instability.

Hereafter a description will be given of two methods to overcome the aforementioned unbalance in electrostatic forces on the diaphragms of electrostatic loudspeakers of the prior art, such as, but not limited to the electrostatic loudspeaker with multiple plate electrodes as described by Maeda in U.S. Pat. No. 5,471,540, but also of the electrostatic loudspeakers with N diaphragms and N+1 stators, where N is equal or larger than two, as described in the current teaching.

Figure 8:
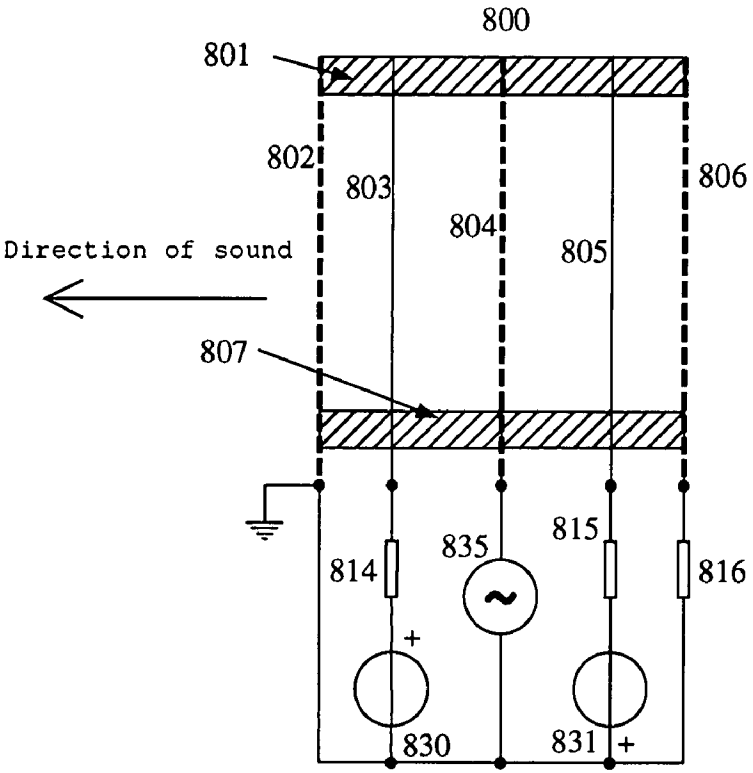
FIG. 8 shows a first method to substantially equalize the electrostatic force between the diaphragms and the stators.

A first method to overcome the aforesaid unbalance in electrostatic forces on the diaphragms is shown in FIG. 8 based on, but not limited to the electrostatic loudspeaker including two diaphragms and three stators, incorporating the current inventions.

The electrostatic loudspeaker (800) of FIG. 8 includes a front stator (802), a center stator (804) and a back stator (806). Said three stators having a substantially equal relative open surface area established by, but not limited to for instance a homogenous perforation pattern over the entire surface area. The electrostatic loudspeaker (800) of FIG. 8 further includes first and second diaphragms (803,805), where the distance between said front stator and said first diaphragm, and said back stator and said second diaphragm is substantially equal and kept substantially constant by one or several insulating spacers (801). The electrostatic loudspeaker (800) further includes one or several insulating spacers (807) to provide a substantially equal and constant distance between the first diaphragm (802) and the center stator (804), and between the second diaphragm (805) and the center stator (804). The width of the insulating spacers (807) in between the first and second diaphragms (803,805) and the center stator (804) is larger than the width of the insulating spacers (801) in between the front stator (802) and the first diaphragm (803), and the back stator (806) and the second diaphragm (805). Consequently, the electrostatic forces on said first and second diaphragms in the direction of said center stator are reduced. The ratio of the width of insulating spacers 801 and 807 is chosen such that the electrostatic forces on said first and second diaphragms in the direction of said center stator are substantially equal to the electrostatic forces on said first and second diaphragms in the direction of respectively the front stator (802) and the back stator (806). As a result thereof the electrostatic forces on said first and second diaphragms are substantially canceled, thus removing the aforesaid unbalance of electrostatic forces. Said first and second diaphragm remain physically centered on the junction of the insulating spacers 801 and 807.

Figure 9:
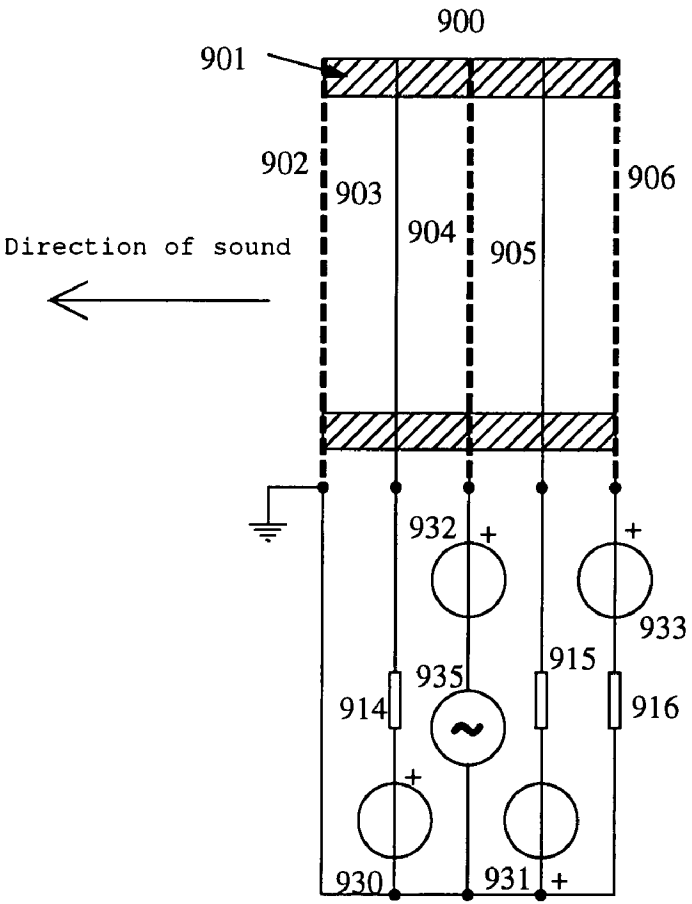
FIG. 9 shows a second method to substantially equalize the electrostatic force between the diaphragms and the stators.

A second method to overcome the aforesaid unbalance in electrostatic forces on the diaphragms is shown in FIG. 9 based on, but not limited to the electrostatic loudspeaker including two diaphragms and three stators, incorporating the current inventions.

The electrostatic loudspeaker (900) of FIG. 9 includes a front stator (902), a center stator (904) and a back stator (906). Said three stators having a substantially equal relative open surface area established by, but not limited to for instance a homogenous perforation pattern over the entire surface area. The electrostatic loudspeaker (900) of FIG. 9 further includes first and second diaphragms (903,905), where the distance between said stators to said diaphragms is substantially equal. The electrostatic loudspeaker (900) further includes first, second, third and fourth DC bias voltage sources (930,931,932, 933), first, second and third resistors (914,915,916) and a single ended AC audio source (935) referenced to the front stator (902). Said front stator is connected to a electrically safe reference potential. In the electrostatic loudspeaker (800) of FIG. 8 the aforesaid unbalance in electrostatic forces on the diaphragms is overcome by adjusting the distance between the diaphragms and the stators. In the electrostatic loudspeaker (900) of FIG. 9 the aforesaid unbalance in electrostatic forces on the diaphragms is overcome by adjusting the voltages on the stators. To overcome the unbalance in electrostatic forces on the first diaphragm (903), the DC voltage between said first stator and said center stator is reduced by adding a positive DC bias voltage to said center stator, supplied by the second DC bias source (932). The voltage between said first diaphragm and said front stator is substantially equal to the voltage of the first DC bias source (930). The voltage between said first diaphragm and said center stator is substantially equal to the voltage of the first DC bias source (930) subtracted by the voltage of the second DC bias source (932). The voltage between the second diaphragm (905) and the center stator (904) is substantially equal in magnitude but opposite in polarity to the voltage between said first diaphragm and said center stator. Consequently, the voltage of the third DC bias source (931) is substantially equal but opposite in polarity to the voltage of said first DC bias source subtracted by two times the voltage of said second DC bias source. The voltage between the second diaphragm (905) and the back stator (906) is substantially equal but opposite in polarity to the voltage between said first diaphragm and said front stator. Consequently, the magnitude of the voltage of the fourth DC bias source (933) is substantially equal to two times the voltage of the second DC bias source (932). Without limitation, some practical values for the DC bias sources can be: for the first DC bias source (930), 3000V; for the second DC bias source (932), 500V; for the third DC bias source (931), −2000V; and for the fourth DC bias source (933), 1000V. The effective magnitude of the voltages between said diaphragms and said front or back stator in the aforesaid example is 3000V. The effective magnitude of the voltage between said diaphragms and said center stator in the aforesaid example is 2500V. As a result thereof the electrostatic forces on said first and second diaphragms are substantially canceled, thus removing the aforesaid unbalance of electrostatic forces. Said first and second diaphragm remain physically centered in between the stators.

The magnitude of the aforesaid unbalance of electrostatic forces as a result of relative open surface area of the stators depends on the ratio of open area with respect to the total surface area of the stators. The magnitude of the aforesaid unbalance of electrostatic forces as a result of relative open surface area of the stators further depends on the ratio of the dimensions of the actual openings or perforations in the stators with respect to the distance between the diaphragms and the stators.

A method to predict the unbalance of electrostatic forces as a result of relative open surface area of the stators is described below based on the electrostatic loudspeaker (600) a shown in FIG. 6. The voltage on the first diaphragm (603) is substantially equal but opposite in polarity to the voltage of the second diaphragm (605), referenced to the voltage on the center stator (604). Consequently, the voltage of the electrical field in the center between the first and second diaphragms is substantially the same as the voltage on the center stator. As a result, the center stator (604) appears to be a fully closed plate from an electrical field point of view as seen from the first and second diaphragms (603,605). It is now possible to measure or calculate the difference in electrostatic forces on said first and second diaphragms. The ratio between the electrostatic forces on the first diaphragm (603) and the front stator (602), and the electrostatic forces on the first diaphragm (603) and the center stator (602) is substantially the same as the ratio between the capacitance between the first diaphragm (603) and the front stator (602), and the capacitance between the first diaphragm (603) and the center stator (602), where the center stator is replaced by a fully closed plate with effectively 0% open area.

For a further teaching of the application of the aforementioned capacitance ratio in the determination of insulating spacer width in the electrostatic loudspeaker of FIG. 8 and the DC bias voltages in the electrostatic loudspeaker of FIG. 9, the capacitance between the diaphragm and a stator with a substantial relative open surface area established by, but not limited to for instance a homogenous perforation pattern over the entire surface area, effectively the front or back stators as described in most areas of this teaching, is called Cdfb. The capacitance between the diaphragm and a stator comprising of a fully closed plate with substantially 0% open area, effectively the center stator positioned in the center of two substantially equal but opposite charged diaphragms as described in most areas of this teaching, is called Cdc.

A first physics principle relevant to the current teaching is that the electrostatic force between two parallel plates increases linearly with the voltage applied between said plates as expressed in the following simplified equation (Eq. 1) where F represents said electrostatic force, V represents said voltage applied between the plates and a and b are constants determined by other factors which are outside the scope of the current teaching.

$$F=a.V+b \quad \text{(Eq. 1)}$$

A second physics principle relevant to the current teaching is that the electrostatic force between two parallel plates increases inversely with the distance between said plates as expressed in the following simplified equation (Eq. 2) where F represents said electrostatic force, D represents said distance between the plates and n and m are constants determined by other factors which are outside the scope of the current teaching.

$$F=n/D+m \quad \text{(Eq. 2)}$$

A third physics principle relevant to the current teaching is that the capacitance between two parallel plates increases inversely with the distance between said plates as expressed in the following simplified equation (Eq. 3) where C represents said capacitance, D represents said distance between the plates and x and y are constants determined by other factors which are outside the scope of the current teaching.

$$C=x/D+y \quad \text{(Eq. 3)}$$

From the second and third equation (Eq. 2, Eq. 3) it can be derived that the electrostatic force (F) between two plates and the capacitance (C) between said plates are linearly related. From the first equation (Eq. 1) and the combination of said second and third equations it is clear that the electrostatic force (F) can be adjusted by either adjusting the voltage (V) or the capacitance (C) or a combination thereof.

In the electrostatic loudspeaker (800) of FIG. 8, the electrostatic force between the diaphragms (803,805) and the outer stators (802,806) is substantially equalized to the electrostatic force between the diaphragms (803,805) and the center stator (804) by equalizing the respective capacitances. Since the capacitances are inversely related to the distance between said diaphragms and said stators, the relationship between the width of insulating spacers 801 and 807 (W801 and W807), and measured or calculated capacitances Cdfb and Cdc is expressed in Eq. 4.

$$Cdc/W807=Cdfb/W801 \quad \text{(Eq. 4.)}$$

In the electrostatic loudspeaker (900) of FIG. 9, the electrostatic force between the diaphragms (903,905) and the outer stators (902,906) is substantially equalized to the electrostatic force between the diaphragms (903,905) and the center stator (904) by adjusting the voltages. Since the electrostatic forces and therefore the capacitances are linearly related to the voltages between said diaphragms and said stators, the relationship between the voltages on stators 902 and 904 (V902 and V904) in reference to the voltage on the diaphragm (903), and measured or calculated capacitances Cdfb and Cdc is expressed in Eq. 5.

$$V902/Cdc=V904/Cdfb \quad \text{(Eq. 5.)}$$

Figure 10:
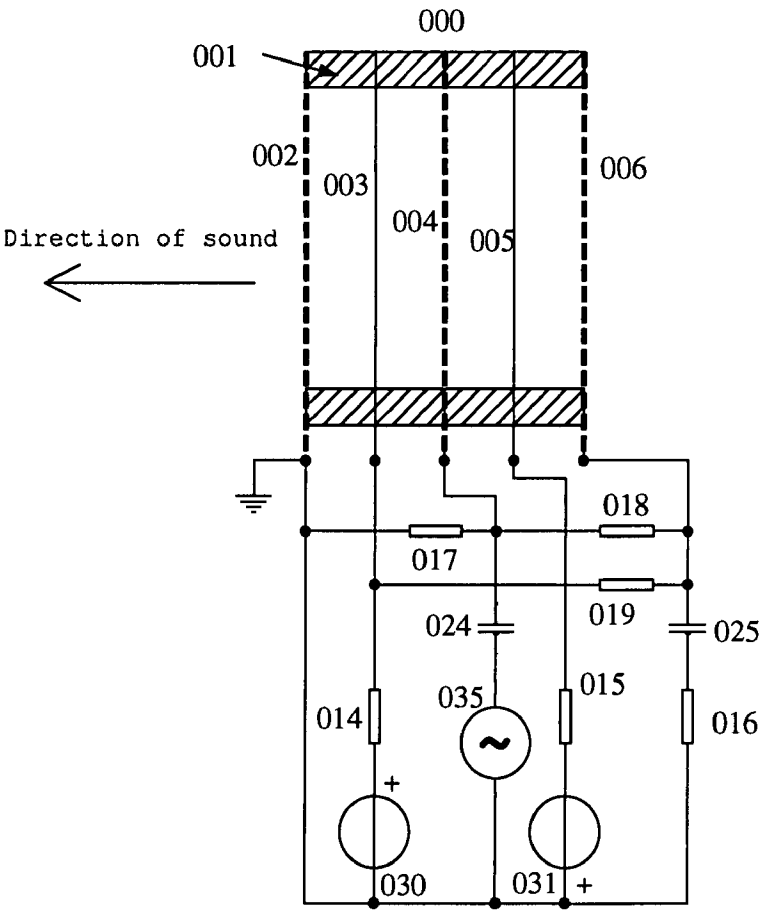
FIG. 10 illustrates the preferred embodiment of all aspects of the current invention.

The preferred embodiment of all aspects of the current invention is shown in FIG. 10. An electrostatic loudspeaker panel (000) includes a front stator (002) connected to a safe reference potential such as, but not limited to earth or ground potential, a center stator (004), a back stator (006), first and second diaphragms (003,005) and several insulating spacers. Said stators, diaphragms and insulating spacers are similar in function, construction and properties as the stators, diaphragms and insulating spacers described earlier in this teaching. The electrostatic loudspeaker of FIG. 10 further includes first and second DC bias voltage sources (030,031) of equal or different magnitude but opposite polarity, first and second coupling capacitors (024,025), and four voltage divider resistors (014,017,018,019). Said coupling capacitors are dimensioned such that any time constants formed by said coupling capacitors and any other impedances in the circuit are substantially longer than the period of the lowest frequency intended to be reproduced by the electrostatic loudspeaker. Furthermore, said voltage divider resistors divide the voltage of the first DC bias source (030) to provide different bias voltages to the first diaphragm (003), the center stator (004) and the back stator (006). The second DC bias source (031) provides a DC bias voltage for the second diaphragm (005). The object of the DC bias voltages on the different diaphragms and stators of the electrostatic loudspeaker of FIG. 10, provided by said first and second DC bias sources in combination with said voltage divider resistors is the same as the object of the DC bias voltages on the different diaphragms and stators of the electrostatic loudspeaker of FIG. 9. Therefore the detailed description of the electrostatic loudspeaker of FIG. 9, mentioned above also applies for the electrostatic loudspeaker of FIG. 10. The function and value considerations of resistor 016 are substantially the same as the function and value considerations of resistor 616 in FIG. 6. Therefore the detailed description of the function and value considerations of resistor 616 of FIG. 6 mentioned above, also applies for the function and value considerations of resistor 016 of FIG. 10.

Figure 11:
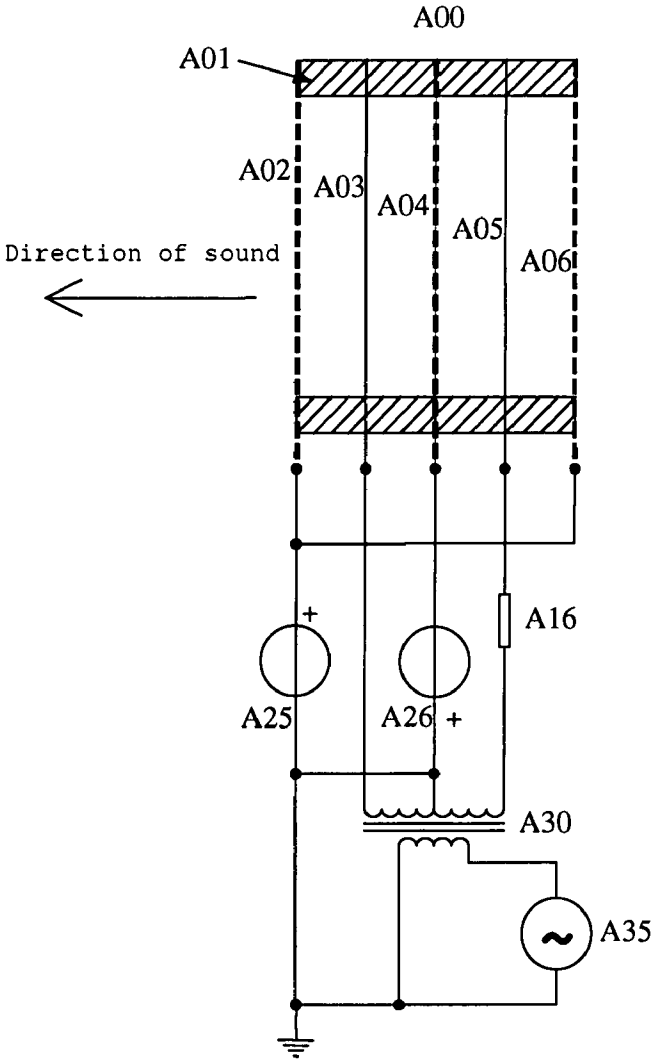
FIG. 11 shows the implementation of the current invention in the invertedly driven electrostatic speaker as described in the prior art of U.S. Pat. No. 7,054,456.

An implementation of the current invention in the prior art of U.S. Pat. No. 7,054,456 is shown in FIG. 11. An electrostatic loudspeaker panel (A00) includes a front stator (A02), a center stator (A04), a back stator (A06), first and second diaphragms (A03,A05) and several insulating spacers (A01). Said stators, diaphragms and insulating spacers are similar in function, construction and properties as the stators, diaphragms and insulating spacers described earlier in this teaching. The electrostatic loudspeaker of FIG. 11 further includes first and second DC bias voltage sources (A25,A26) of equal or different magnitude but opposite polarity and a step up transformer (A30) with a center tap on its secondary winding which is connected to ground. The front stator (A02) and back stator (A06) are directly or indirectly connected to DC bias voltage source A25. The center stator (A04) is directly or indirectly connected to DC bias voltage source A26. One side of the secondary winding of said balancing transformer is directly connected to the first diaphragm (A03) and the other side of the secondary winding of said balancing transformer is connected to the second diaphragm (A05) through a resistor (A16). The function and value considerations of resistor A16 are substantially the same as the function and value considerations of resistor 616 in FIG. 6. Therefore the detailed description of the function and value considerations of resistor 616 of FIG. 6 mentioned above, also applies for the function and value considerations of resistor A16 of FIG. 11. The same methods to overcome the unbalance in electrostatic forces on the diaphragms as described above with respect to FIG. 8 and FIG. 9 is valid for the electrostatic loudspeaker of FIG. 11. If the first and second DC bias voltage sources (A25,A26) are of equal magnitude but opposite polarity, the abovementioned force balancing method employing spacers of unequal distance as illustrated in FIG. 8 will be used. In the embodiment of the current invention illustrated in FIG. 11 using equal distance spacers between the stators and diaphragms the force balancing method of FIG. 9 employing different amplitudes of DC bias voltage sources will be used. An exemplary value for the magnitude of DC bias voltage sources A25 is +3000V. An exemplary value for the magnitude of DC bias voltage sources A26 is −2500V.

The stators of the electrostatic loudspeaker panel (A00) in FIG. 11 do not contain any AC audio signal. It is therefore another feature of the current invention implemented in the prior art of U.S. Pat. No. 7,054,456 that the front and back stators (A02,A06) can be connected to an electrically safe reference potential such as, but not limited to earth or ground potential. Similar to the aforementioned exemplary values for the magnitude of the DC bias voltage sources (A25,A26), the bias potential on the diaphragms (A03,A05) is −3000V and the bias potential on the center stator (A04) is −5500V.

For in particular, but not limited to the electrostatic loudspeakers of FIG. 9, FIG. 10 and FIG. 11, but also for the electrostatic loudspeakers with N diaphragms and N+1 stators, where N is equal or larger than two, as described in the current teaching, and for the prior art, such as, but not limited to the electrostatic loudspeaker with multiple plate electrodes as described by Maeda in U.S. Pat. No. 5,471,540, a combination of the insulating spacer method and the DC bias method, to overcome the unbalance of electrostatic forces on the diaphragms, as shown in FIG. 8, FIG. 9 and FIG. 10 can be used.

What is claimed is:

1. An electrostatic loudspeaker system comprising:

an electrically conductive front stator, an electrically conductive diaphragm, an electrically conductive back stator, one or several electrically isolated spacers to maintain a substantially controlled distance between said diaphragm and stators over their surface area, a first and second capacitor, a first and second resistor and a bias power supply, wherein:

said stators have a substantially distributed open area to pass sound waves through, the front stator is connected to a safe reference potential, the first and second capacitors are connected in series between the front stator and the back stator, the diaphragm is connected through the first resistor to the junction of said first and second capacitors, the bias power supply is referenced to the front stator and provides a DC bias voltage through the second resistor to the junction of said first and second capacitors, the audio driver signal is supplied to the back stator, and the audio driver signal is supplied from a directly coupled single ended source referenced to said front stator, or by an indirectly coupled source by means of a transformer or any other indirect coupling method.

2. The electrostatic loudspeaker system according to claim 1, wherein, the function of the first resistor and the first and second capacitors is carried out by the capacitance between the front stator and the diaphragm and the capacitance between the second stator and the diaphragm, the second resistor is directly connected between the bias power supply and the diaphragm, said diaphragm has a low enough surface resistance as to keep the electrical charge substantially equal over the surface of the diaphragm when an AC signals is applied between said front and back stators.

3. An electrostatic loudspeaker system comprising:

N electrically conductive diaphragms, N+1 electrically conductive stators, one or several electrically isolated spacers to maintain a substantially controlled distance between said diaphragm and stators over their surface area, N resistors and a first and second bias power supply, wherein:

said stators have a substantially distributed open area to pass sound waves through, the front stator, being the first stator, and every consecutive odd numbered stator is connected to a safe reference potential, the front diaphragm, being the first diaphragm, and every consecutive odd numbered diaphragm are connected through the first resistor to the first bias power supply, the second diaphragm and every consecutive even numbered diaphragm are connected through the second resistor to the second bias power supply, said diaphragms have a low enough surface resistance as to keep the electrical charge substantially equal over the surface of the diaphragm when an AC signals is applied between said stators, the first and second bias power supplies are referenced to the front stator and provide a DC bias voltage, of opposite polarity, the audio driver signal is supplied to the second stator and every consecutive even numbered stator, the audio driver signal is supplied from a directly coupled single ended source referenced to said front stator, or by an indirectly coupled source by means of a transformer or any other indirect coupling method, the excursions of all diaphragms as a result of the audio driver signal occur in the same direction, causing a substantial addition of the sound pressure of each individual diaphragm.

4. The electrostatic loudspeaker system according to claim 3 further comprising:

N−1 additional resistors wherein, the front stator, being the first stator, is connected to a safe reference potential, the third stator and every consecutive odd numbered stator has a resistor connected in series, each of said resistors form a low pass filter with the capacitance of the stators it is connected to, the sound pressure of each individual diaphragm is only substantially added to the sound pressure of the first diaphragm for frequencies substantially below the corner frequency of the low pass filter formed by the capacitance of each stator and its respective series resistor.

5. The electrostatic loudspeaker system according to claim 3 further comprising:

a third resistor wherein, the second stator is divided up in two or more electrically isolated segments, a subset of the electrically isolated segments of the second stator only have a first diaphragm between the front stator, being the first stator, and said second stator segments, said subset of the electrically isolated segments of the second stator have no other diaphragms between other stators parallel to said subset of segments of the second stator, said subset of the electrically isolated segments of the second stator is directly coupled to the audio driver signal, the remaining segments of the second stator are connected to all consecutive even numbered stators, the third resistor is connected between the junction of the even numbered stator connection and the audio driver source, the third resistor forms a low pass filter with the capacitance of the stators and stator segments it is connected to, said subset of directly coupled segments of the second stator reproduce the entire frequency content of the audio driver source, the sound pressure of each individual diaphragm of the remaining segments is substantially added to the sound pressure of the first diaphragm for frequencies substantially below the corner frequency of the low pass filter formed by the third resistor and the capacitance of the stators and stator segments it is connected to.

6. The electrostatic loudspeaker system according to claim 5:

wherein, said subset of the electrically isolated segments of the second stator have more than one other diaphragms, but less than N diaphragms between other stators parallel to said subset of segments of the second stator.

7. The electrostatic loudspeaker systems according to claim 3:

wherein, the distance between the front stator, being the first stator, and the front diaphragm, being the first diaphragm, is reduced to substantially equalize the electrostatic forces between said front stator and said front diaphragm, and the second stator and said front diaphragm, when no audio driver signal is present, the distance between the back stator, being the $(N+1)^{th}$ stator and the back diaphragm, being the $N^{th}$ diaphragm, is reduced to substantially equalize the electrostatic forces between said back stator and said back diaphragm, and the $N^{th}$ stator and said back diaphragm, when no audio driver signal is present.

8. The electrostatic loudspeaker system according to claim 3, further comprising:

additional bias power supplies, wherein, the absolute voltage between the front stator, being the first stator, and the front diaphragm, being the first diaphragm, is increased to substantially equalize the electrostatic forces between said front stator and said front diaphragm, and the second stator and said front diaphragm, when no audio driver signal is present, the absolute voltage between the back stator, being the $(N+1)^{th}$ stator and the back diaphragm, being the $N^{th}$ diaphragm, is increased to substantially equalize the electrostatic forces between said back stator and said back diaphragm, and the $N^{th}$ stator and said back diaphragm, when no audio driver signal is present.

9. The electrostatic loudspeaker system according to claim 3, further comprising:

a third and fourth bias power supply, wherein,

N=2, the third bias power supply is connected between the audio driver source and the center stator, the fourth bias power supply is connected between the back stator and the front stator, the absolute voltage between the front diaphragm and the center stator is reduced to substantially equalize the electrostatic forces between the front stator and the front diaphragm, and the center stator and said front diaphragm, when no audio driver signal is present, the absolute voltage between the back diaphragm and the center stator, is reduced to substantially equalize the electrostatic forces between the back stator and said back diaphragm, and the center stator and said back diaphragm, when no audio driver signal is present.

10. The electrostatic loudspeaker system according to claim 3, further comprising:

a multitude of resistors for dividing voltage, a first and second capacitor for blocking DC current, wherein,

N=2, the first bias power supply connected to a voltage divider consisting of four resistors supplying a part of de DC voltage from said first bias power supply to the front diaphragm, another part of said DC voltage to the back stator and yet another part of said DC voltage to the center stator, the absolute voltage between the front diaphragm and the center stator is reduced to substantially equalize the electrostatic forces between the front stator and the front diaphragm, and the center stator and said front diaphragm, when no audio driver signal is present, the absolute voltage between the back diaphragm and the center stator, is reduced to substantially equalize the electrostatic forces between the back stator and said back diaphragm, and the center stator and said back diaphragm, when no audio driver signal is present, the audio driver signal is supplied to the center stator through the first DC blocking capacitor, the audio driver signal is supplied from a directly coupled single ended source referenced to said front stator, or by an indirectly coupled source by means of a transformer or any other indirect coupling method, and the back stator is connected to the front stator through the second DC blocking capacitor.

11. The electrostatic loudspeaker system according to claim 10:

wherein, the back stator has a resistor connected in series, said resistor forms a low pass filter with the capacitance of the back stator, the sound pressure of each individual diaphragm is only substantially added to the sound pressure of the first diaphragm for frequencies substantially below the corner frequency of the low pass filter formed by the capacitance of the back stator and its series resistor.

12. An electrostatic loudspeaker system comprising:

two electrically conductive diaphragms, three electrically conductive stators, one or several electrically isolated spacers to maintain a substantially controlled between said diaphragm and stators over their surface area, a first and second bias power supply, a transformer having primary and secondary windings, wherein:

said stators have a substantially distributed open area to pass sound waves through, said transformer includes a secondary winding with start and end connections and a center tap connection, said center tap connection is connected to a reference potential, the first and second bias power supplies are referenced to the center tap connection of said transformer and provide a DC bias voltage, of opposite polarity, the front stator and the back stator are connected to the first bias power supply, the center stator is connected to the second bias power supply, the front diaphragm is connected to the start connection of the secondary winding of the transformer, the back diaphragm is connected to the end connection of the secondary winding of the transformer, said diaphragms have a low enough surface resistance as to keep the electrical charge substantially equal over the surface of the diaphragm when an AC signals is applied between said diaphragms, the audio driver signal is supplied to the primary winding of the transformer, the excursions of the front and back diaphragms as a result of the audio driver signal occur in the same direction, causing a substantial addition of the sound pressure of each individual diaphragm.

13. The electrostatic loudspeaker system according to claim 12:

wherein, the front stator and the back stator are connected to a safe reference potential, the center tap connection of the transformer is not connected to said reference potential.

14. The electrostatic loudspeaker system according to claim 12, further comprising:

a first resistor wherein, said first resistor is connected in series with the back diaphragm, said resistor forms a low pass filter with the capacitance of the diaphragm it is connected to, the sound pressure of the back diaphragm is only substantially added to the sound pressure of the front diaphragm for frequencies substantially below the corner frequency of the low pass filter formed by the capacitance of the back diaphragm and said resistor.

15. The electrostatic loudspeaker system according to claim 12 wherein, the distance between the front stator and the front diaphragm is reduced to substantially equalize the electrostatic forces between the front stator and the front diaphragm, and the center stator and said front diaphragm, when no audio driver signal is present, the distance between the back stator and the back diaphragm is reduced to substantially equalize the electrostatic forces between said back stator and said back diaphragm, and the center stator and said back diaphragm, when no audio driver signal is present.

16. The electrostatic loudspeaker system according to claim 12 wherein, the absolute voltage between the front stator and the front diaphragm is increased to substantially equalize the electrostatic forces between said front stator and said front diaphragm, and the center stator and said front diaphragm, when no audio driver signal is present, the absolute voltage between the back stator and the back diaphragm is increased to substantially equalize the electrostatic forces between said back stator and said back diaphragm, and the center stator and said back diaphragm, when no audio driver signal is present.

* * * * *